US011654677B2

(12) United States Patent
Reinten et al.

(10) Patent No.: US 11,654,677 B2
(45) Date of Patent: May 23, 2023

(54) LIQUID JETTING DEVICE

(71) Applicant: Canon Production Printing Holding B.V., Venlo (NL)

(72) Inventors: Hans Reinten, Venlo (NL); Youri G. J. P. De Loore, Venlo (NL)

(73) Assignee: CANON PRODUCTION PRINTING HOLDING B.V., Venlo (NL)

( * ) Notice: Subject to any disclaimer, the term of this patent is extended or adjusted under 35 U.S.C. 154(b) by 57 days.

(21) Appl. No.: 17/369,233

(22) Filed: Jul. 7, 2021

(65) Prior Publication Data

US 2022/0016884 A1 Jan. 20, 2022

(30) Foreign Application Priority Data

Jul. 20, 2020 (EP) ..... 20186743

(51) Int. Cl.
*B41J 29/38* (2006.01)
*B41J 2/045* (2006.01)

(52) U.S. Cl.
CPC ..... *B41J 2/04588* (2013.01); *B41J 2/04581* (2013.01); *B41J 2/04596* (2013.01)

(58) Field of Classification Search
CPC ..... B41J 2/04581; B41J 2/04588
See application file for complete search history.

(56) References Cited

U.S. PATENT DOCUMENTS

2004/0017413 A1* 1/2004 Kusunoki ..... B41J 2/04581 347/11
2014/0125722 A1 5/2014 Otokita
2016/0375683 A1 12/2016 Veenstra et al.
2018/0086055 A1 3/2018 Takamura
2019/0224967 A1 7/2019 Massucci

FOREIGN PATENT DOCUMENTS

EP 2 072 259 A1 6/2009
EP 1 378 360 B1 9/2011
EP 1 378 359 B1 12/2011

OTHER PUBLICATIONS

European Search Report, issued in Application No. 20 18 6743, dated Dec. 9, 2020.

* cited by examiner

*Primary Examiner* — Lam S Nguyen
(74) *Attorney, Agent, or Firm* — Birch, Stewart, Kolasch & Birch, LLP

(57) ABSTRACT

A liquid jetting device is arranged to eject a droplet of a liquid. The device includes a nozzle, a liquid duct connected to the nozzle, an electro-mechanical transducer arranged to create an acoustic pressure wave in the liquid in the duct, and an electronic control system arranged to apply to the transducer a voltage signal having a waveform configured for ejecting a droplet from the nozzle. The waveform is further configured to quench a residual acoustic pressure wave in the liquid duct and includes a jet pulse, a subsequent first quench pulse having a polarity opposite to that of the jet pulse, and a subsequent second quench pulse having the same polarity as the jet pulse.

3 Claims, 3 Drawing Sheets

LIQUID JETTING DEVICE

CROSS-REFERENCE TO RELATED APPLICATIONS

This application claims priority to European Patent Application No. 20186743.9, filed on Jul. 20, 2020, the entirety of which is expressly incorporated herein by reference.

BACKGROUND OF THE INVENTION

1. Field of the Invention

The invention relates to a liquid jetting device arranged to eject a droplet of a liquid and comprising a nozzle, a liquid duct connected to the nozzle, an electro-mechanical transducer arranged to create an acoustic pressure wave in the liquid in the duct, and an electronic control system arranged to apply to the transducer a voltage signal having a waveform configured for ejecting the droplet from the nozzle and then quenching a residual acoustic pressure wave in the liquid duct.

More particularly, the invention relates to an ink jet printer.

2. Description of the Related Art

The electro-mechanical transducer may for example be a piezoelectric transducer forming a part of a wall of the duct. When a voltage pulse is applied to the transducer, this will cause a mechanical deformation of the transducer. As a consequence, an acoustic pressure wave is created in the liquid ink in the duct, and when the pressure wave propagates to the nozzle, an ink droplet is expelled from the nozzle.

When the droplet has left the nozzle, a residual pressure wave will gradually decay in the ink duct. This may compromise the ejection of a subsequent droplet, due to interference, and/or, worse, may cause air to be drawn in at the nozzle, whereby the performance of the jetting device is compromised on a longer term.

US 2016/375683 A1 describes a jetting device wherein a so-called quench pulse is applied to the transducer with a certain delay after the end of the jetting pulse. The delay time and the amplitude of the quench pulse are selected such that the residual pressure wave will be cancelled as far as possible by destructive interference. Preferably, the quench pulse has a polarity opposite to that of the jetting pulse. Polarity refers in this case to the direction of a leading flank of a pulse, rather than its position relative to a certain reference voltage that is applied to the transducer in the non-active state. When such a bipolar waveform is used for quenching the residual pressure wave, the suitable delay time is relatively short in comparison to the oscillation period of the pressure wave, so that the pressure wave can be suppressed quickly and an excessive deformation of the air/liquid meniscus at the nozzle can be avoided.

In principle, it is also possible to employ a monopolar waveform wherein the jetting pulse and the quench pulse have the same polarity. In this case, the delay time must be larger in order to achieve destructive interference, and consequently there is a larger risk that the residual pressure wave causes hazard before it is quenched. On the other hand, a monopolar waveform has the advantage that the total voltage spread of the waveform may be smaller. If the voltage source that is employed for supplying the voltage to the transducer has only a relatively small dynamic range, it may be necessary to recur to such monopolar waveforms.

It is an object of the invention to provide a jetting device in which residual pressure waves can be suppressed quickly and efficiently with a reduced voltage spread of the waveform.

SUMMARY OF THE INVENTION

In order to achieve this object, according to the invention, the waveform comprises a jetting pulse, a subsequent first quench pulse having a polarity opposite to that of the jetting pulse, and a subsequent second quench pulse having the same polarity as the jetting pulse.

Thus, even if the dynamic range of the voltage source is not sufficient for suppressing the pressure wave with the bipolar first quench pulse alone, it is not necessary to use a monopolar waveform, but the available voltage spread can be utilized for creating the first quench pulse with opposite polarity, so that the pressure wave starts to be dampened earlier, and the second quench pulse is utilized only for cancelling the rest of the pressure wave. In this way, the risk of detrimental effects of the residual pressure wave can be reduced significantly.

Useful details and preferred embodiments of the invention are indicated in the dependent claims.

The jetting device may be an ink jet printer, e.g. a piezoelectric ink jet printer having a large number of jetting units each of which comprise a nozzle, an ink duct and a transducer. Then, the amplitudes of the jetting pulses applied to each transducer may be adjusted individually for each transducer in order to compensate for performance differences between the transducers and to obtain ink droplets of uniform size. The waveforms to be applied to each transducer may be parametrized with a "blending" parameter which determines the weights of the monopolar component and the bipolar component in the waveform so as to optimally utilize the available voltage spread.

EP 1 378 359 A1 and EP 1 378 360 A1 describe ink jet printers which comprise an electronic circuit for measuring the electric impedance of the piezoelectric transducer. Since the impedance of the transducer is changed when the body of the transducer is deformed or exposed to an external mechanical strain, the impedance can be used as a measure of the forces which the liquid in the duct exerts upon the transducer.

Consequently, the impedance measurement can be used for monitoring the pressure fluctuations in the ink that are caused by the acoustic pressure wave that is being generated or has been generated by the transducer.

The impedance measurement may be performed in the intervals between successive voltage pulses. In that case, the impedance fluctuations are indicative of the acoustic pressure wave that is gradually decaying in the duct after a droplet has been expelled. This information may then be used for example for monitoring the decay of the residual pressure waves and thereby to optimize the amplitudes and timings of the quench pulses. Likewise, the impedance measurement may be used for assessing the size of the droplets that have been generated, e.g. in a test mode in which no quench pulses are applied.

Embodiment examples of the invention will now be described in conjunction with the drawings, wherein.

Figure 1:
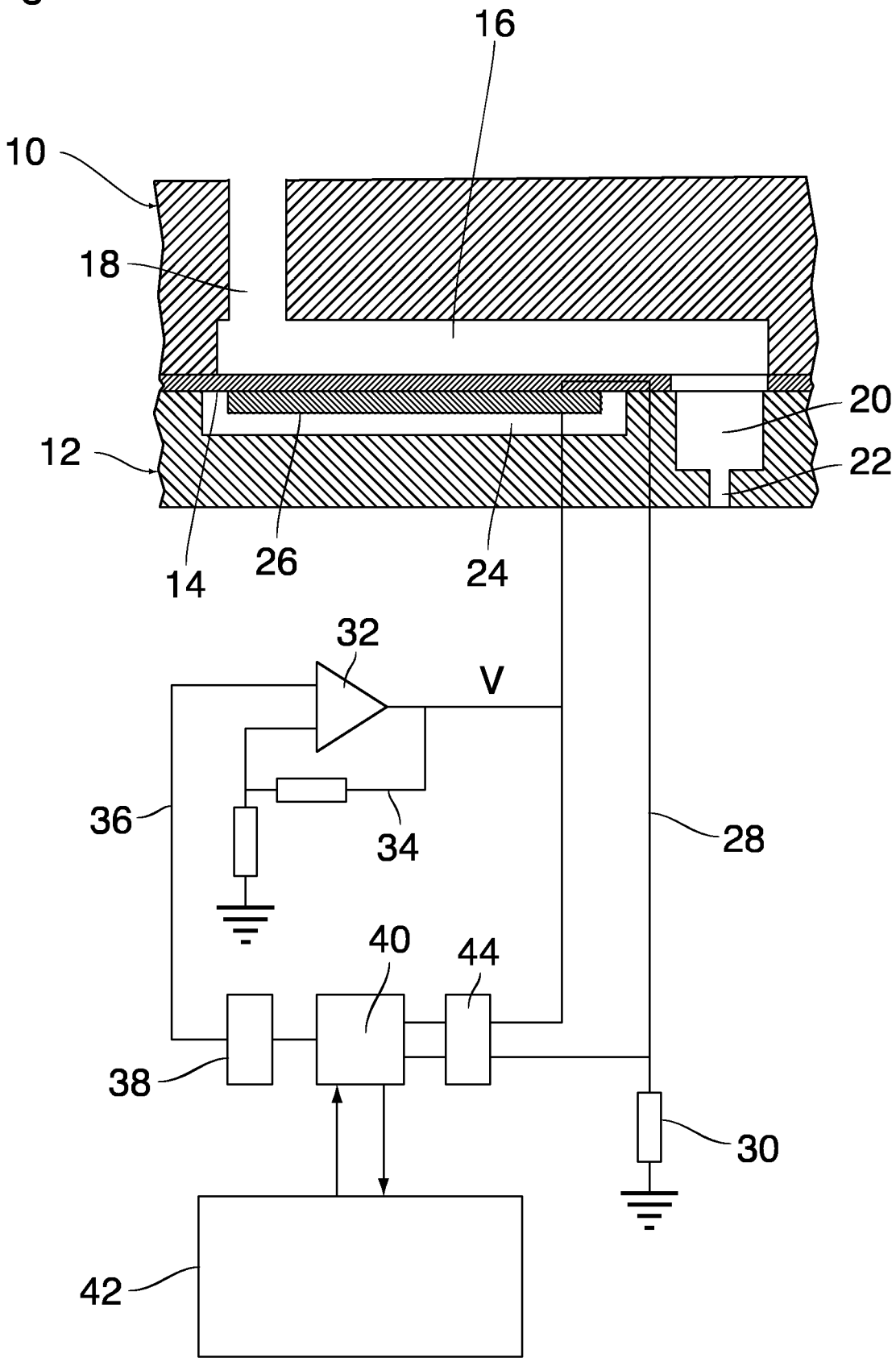
FIG. 1 is a cross-sectional view of an ejection unit of a jetting device according to the invention.

FIG. 1 shows a single ejection unit of an ink jet print head. The print head constitutes an example of a jetting device according to the invention. The device comprises a wafer 10 and a support member 12 that are bonded to opposite sides of a thin flexible membrane 14.

A recess that forms an ink duct 16 is formed in the face of the wafer 10 that engages the membrane 14, e.g. the bottom face in FIG. 1. The ink duct 16 has an essentially rectangular shape. An end portion on the left side in FIG. 1 is connected to an ink supply line 18 that passes through the wafer 10 in thickness direction of the wafer and serves for supplying liquid ink to the ink duct 16.

An opposite end of the ink duct 16, on the right side in FIG. 1, is connected, through an opening in the membrane 14, to a chamber 20 that is formed in the support member 12 and opens out into a nozzle 22 that is formed in the bottom face of the support member.

Adjacent to the membrane 14 and separated from the chamber 20, the support member 12 forms another cavity 24 accommodating a piezoelectric transducer 26 that is bonded to the membrane 14.

The piezoelectric transducer 26 has electrodes (not shown in detail) that are connected to an electronic circuit that has been shown in the lower part of FIG. 1. In the example shown, one electrode of the transducer is grounded via a line 28 and a resistor 30. Another electrode of the transducer is connected to an output of an amplifier 32 that is feedback-controlled via a feedback network 34, so that a voltage V applied to the transducer will be proportional to a signal on an input line 36 of the amplifier. The signal on the input line 36 is generated by a D/A-converter 38 that receives a digital input from a local digital controller 40. The controller 40 is connected to a processor 42.

When an ink droplet is to be expelled from the nozzle 22, the processor 42 sends a command to the controller 40 which outputs a digital signal that causes the D/A-converter 38 and the amplifier 32 to apply a voltage pulse to the transducer 26. This voltage pulse causes the transducer to deform in a bending mode. More specifically, the transducer 26 is caused to flex downward, so that the membrane 14 which is bonded to the transducer 26 will also flex downward, thereby to increase the volume of the ink duct 16. As a consequence, additional ink will be sucked-in via the supply line 18. Then, when the voltage pulse falls off again, the membrane 14 will flex back into the original state, so that a positive acoustic pressure wave is generated in the liquid ink in the duct 16. This pressure wave propagates to the nozzle 22 and causes an ink droplet to be expelled.

The electrodes of the transducer 26 are also connected to an A/D converter 44 which measures a voltage drop across the transducer and also a voltage drop across the resistor 38 and thereby implicitly the current flowing through the transducer. Corresponding digital signals are forwarded to the controller 40 which can derive the impedance of the transducer 26 from these signals. The measured impedance is signalled to the processor 42 where the impedance signal is processed further.

The acoustic wave that has caused a droplet to be expelled from the nozzle 22 will be reflected (with phase reversal) at the open nozzle and will propagate back into the duct 16. Consequently, even after the droplet has been expelled, a gradually decaying acoustic pressure wave is still present in the duct 16, and the corresponding pressure fluctuations exert a bending stress onto the membrane 14 and the actuator 26. This mechanical strain on the piezoelectric transducer leads to a change in the impedance of the transducer, and this change can be measured with the electronic circuit described above. The measured impedance changes represent the pressure fluctuations of the acoustic wave and can therefore be used to derive a pressure signal that describes these pressure fluctuations.

The print head has a plurality of ejection units that are arranged to form one or more parallel rows of nozzles 22 in a common nozzle face. The electrodes of the transducers 26 of all of these ejection units are connected to a circuitry corresponding to the one shown in FIG. 1 for applying energizing pulses to the transducers.

Ideally, the ink ducts 16, the membrane 14 and the transducers 26 should have identical acoustic properties for all ejection units of the device, so that a common control signal consisting of energizing pulses with a common waveform could be applied to the transducers of all ejection units that are to fire at the same time. In practice, however, the acoustic properties of the ejection units may slightly differ from one another due to the presence of solid particles or air bubbles in the ink ducts and/or to uneven ageing of the mechanical components. When the circuitry for measuring the pressure signals is provided for all ejection units, these differences may be detected by analysing these pressure signals, and the differences may at least partly be compensated by individually varying the amplitudes of the energizing pulses for the transducers. Nevertheless, the control signals applied to all the transducers 26 may be derived from a common basic signal that is supplied from the processor 42 and has a basic waveform, the shape of which can be specified by a set of mode parameters, as will now be explained in conjunction with FIGS. 2 to 4.

Figure 2:
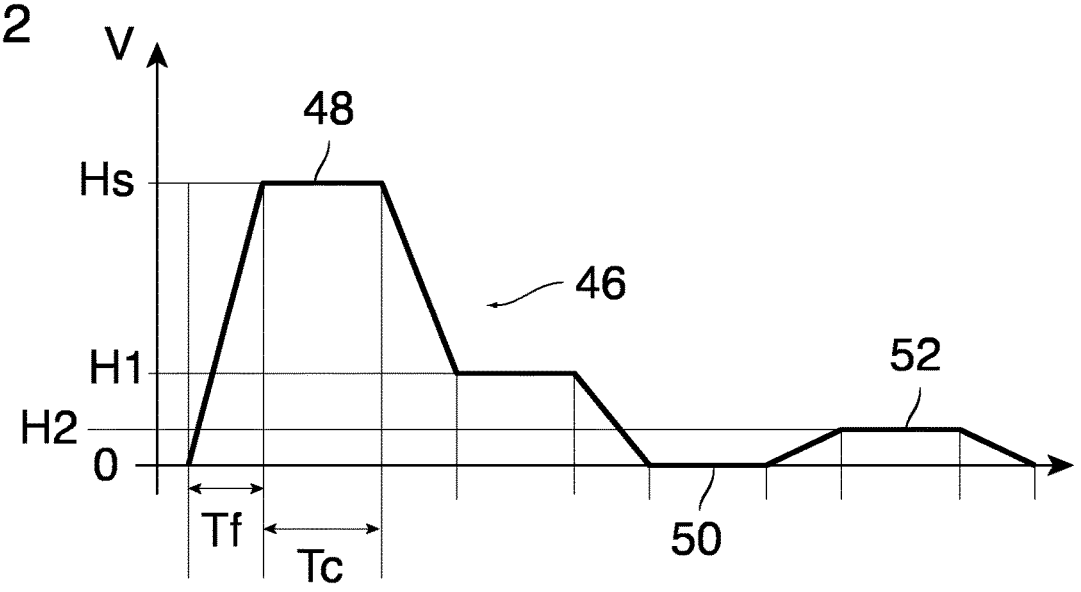
FIG. 2 shows a basic waveform of a voltage to be applied to a transducer of the jetting device.

As is shown in FIG. 2, a waveform 46 of an energizing pulse which is applied to a transducer whenever a droplet is to be expelled from the corresponding ejection unit comprises a jet pulse 48 followed by a first quench pulse 50 and a second quench pulse 52. The jet pulse 48 has the purpose to excite the acoustic wave that will result in the ejection of the droplet, whereas the quench pulses 50, 52 are designed to promote the attenuation of the acoustic wave that will still oscillate in the ink duct when the droplet has been expelled. The polarity of the first quench pulse 50 is opposite to that of the jet pulse 48, and its amplitude is lower because part of the acoustic wave would be dampened anyway even without quench pulse, due to the viscosity of the liquid. The polarity of the second quench pulse 52 is equal to that of the jet pulse 48.

The jet pulse 48 has a rising flank which, in the example shown in FIG. 2, rises from zero voltage to a maximum voltage Hs that the amplifier 32 can provide within a flank time Tf. After a certain hold time Tc during which the voltage is constant, the voltage drops on a descending flank, which has the same flank time Tf, to a voltage H1 which is larger than zero. Thus, the rising flank has the height Hs whereas the falling flank has only a height Hs−H1, so that, since the flank times Tf are equal, the slope of the falling flank is smaller in this example. In other cases, the slopes of both the rising and falling flank are equal and the flank times differ proportional to the voltage difference.

After another hold time Tc during which the voltage is kept constant at H1, the falling flank of the first quench pulse 50 begins. This flank has also the height H1, so that the voltage drops to zero and is kept at zero for another hold time Tc, whereupon a rising flank of the second quench pulse 52 begins. This flank rises to a value H2 which is smaller than H1. The voltage H2 is held for another hold time Tc, and then the voltage drops to zero on a falling flank of the second quench pulse 52. Thereafter, a new cycle may start with a suitable delay.

In this example, the jet pulse 48 and the two quench pulses 50, 52 all have the same flank times Tf and the same hold times Tc. Further, the first quench pulse 50 is delayed relative to the jet pulse 48 by a delay time that is also equal to the hold time Tc in this example.

The timings of the two quench pulses 50, 52 have been selected such that, in view of their opposite polarity, both pulses will cause destructive interference with the residual wave in the ink duct 16. This means, in this case, that the time delay 2 Tf+2 Tc between the rising flank of the jet pulse 48 and the falling flank of the first quench pulse 50 will be equal to the oscillation period of the pressure wave in the ink duct.

In this example, the amplitude of the first quench pulse 50 is not sufficient to fully suppress the pressure wave, and the second quench pulse 52 has the function to eliminate the rest of the pressure wave that has been left over by the first quench pulse.

Whereas the voltage Hs is determined by the fact that the voltage source can only provide output voltages between 0 and Hs, the flank times, the hold and delay times and the voltages H1 and H2 constitute parameters that may be varied in order to shape the waveform 46.

It is convenient to keep the flank times and hold and delay times constant and further, that the time delays between all consecutive flanks are chosen to be integer multiples of a certain number which is proportional to the natural period of oscillation of the ink in the ink duct. In view of the varying properties of the ink ejection units, in particular the varying efficiency of the piezoelectric transducer, it is desirable to vary the effective amplitude of the jet pulse 48, e.g. in order to equalize the volumes of the ink drops that are jetted out by the different jetting units.

Figure 3:
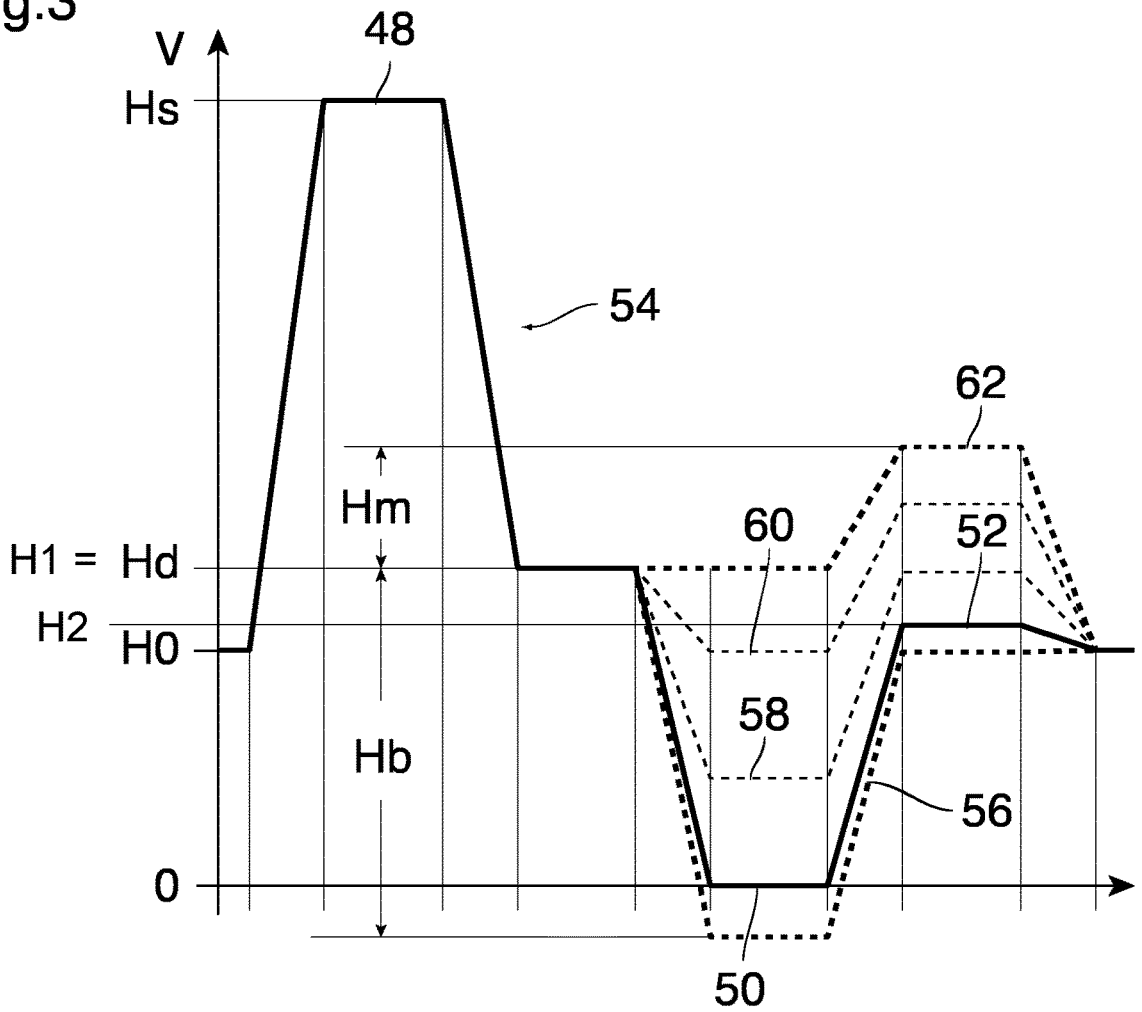
FIG. 3 shows examples of different waveforms.

FIG. 3 shows an example of a modified waveform 54 wherein the rising flank of the jet pulse 48 starts from a rest voltage H0 that is larger than zero. Further, the falling flank of the jet pulse 48 drops to a value Hd that is not necessarily equal to the height of the subsequent falling flank of the first quench pulse 50. The voltages H0 and Hd constitute additional parameters that may be utilized to adjust the effective amplitude of the jet pulse 48, i.e. the average of the height of the rising flank and the descending flank.

In order to eliminate the residual pressure wave in the ink duct as quickly as possible, it would be desirable to utilize a purely bipolar waveform 56 that has only the first quench pulse 50 but no second quench pulse 52, as has been indicated in dashed lines in FIG. 3. However, in order to cancel the residual pressure wave with the quench pulse 50 alone, the amplitude of this pulse would have to be so high that the entire waveform 56 does no longer fit into the dynamic range from 0 to Hs of the voltage source. In other words, the first quench pulse 50 would have to have a negative voltage which the amplifier 32 cannot produce. For this reason, the waveform 54 has been tuned such that the first quench pulse 50 is as large as possible without dropping below zero, and the rest of the quenching is done with the second quench pulse 52. There are also other reasons for wanting to use a composed quench pulse, having both an opposite polarity part 50 and a same polarity part 52, such that a proper balance may be struck between various jetting characteristics, such as jetting stability, drop size, refill behaviour, etc.

FIG. 3 shows also examples of other waveforms 58, 60, 62 which the amplifier 32 would be able to produce but which may be less favourable for the given amplitude of the jet pulse. It is noted that the waveform 62 is a pure monopolar waveform having only the second quench pulse but no first quench pulse, whereas the pure bipolar waveform, having only a first quench pulse, is not feasible in this case, because it requires a voltage outside the available voltage range.

The waveforms 54-62 can all be described by a "polarity" parameter p which varies between 0 (pure monopolar) and 1 (pure bipolar). The parameter p can have any value within this interval and can define a blend between the monopolar waveform 62 and the bipolar waveform 56 with weights p and 1−p.

Figure 4:
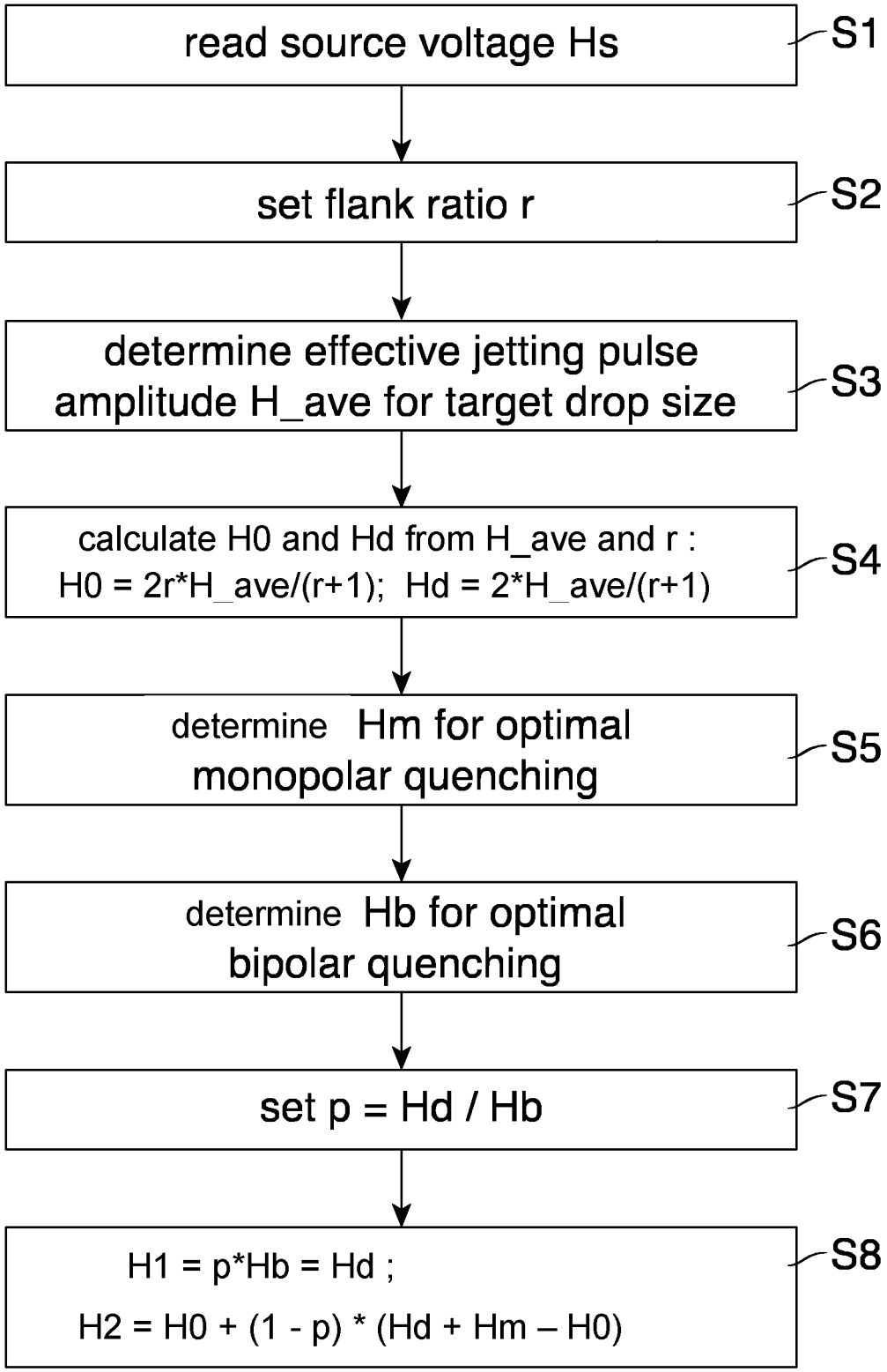
FIG. 4 is a flow diagram of a method for determining parameters for the waveform.

FIG. 4 is a flow diagram illustrating an example of a method for determining the parameters of the waveform 54 for a given jetting unit in the case that all jetting units use the maximum voltage latitude.

Step S1 is a step of reading the fixed source voltage Hs of the voltage source.

Step S2 is a step of setting a fixed flank ratio r which defines the ratio between the height Hs-H0 of the leading, rising flank of the jet pulse 48 and the height Hs-Hd of the trailing, falling flank of the jet pulse 48. This ratio r may be the same for all jetting units.

Step S3 is a step of determining an effective jet pulse amplitude Have, i.e. the average of the rising flank and the falling flank of the jet pulse $$H_ave = Hs - H0/2 - Hd/2$$

For example, this amplitude may be determined such that all jetting units produce ink droplets of equal size, in spite of possible differences in the performances of the transducers.

Then, in step S4, the voltages H0 and Hd can be calculated from the ratio r and the amplitude H_ave that has been determined in steps S2 and S3.

Step S5 is a step of determining a height Hm of the second quench pulse of the monopolar waveform 62, which height would be required for quenching the pressure wave with the second quench pulse alone. This can for example be determined from a damping parameter as derived form a residual pressure wave analysis or from a direct determination of a minimum residual wave.

Similarly, step S6 is a step of determining a height Hb of the first quench pulse in the purely bipolar waveform 56, which height would be required for quenching the pressure wave with the first quench pulse 50 alone.

Then, in step S7, the quotient Hd/Hb is selected as the polarity parameter p. This choice of the parameter p will assure that the voltage in the first quench pulse 50 drops to zero but does not drop below zero. If p would fall outside the range [0;1], p would be quenched to the end value of the range, i.e. $p<0$ would result in $p=0$ and $p>1$ in $p=1$.

Finally, in step S8, the height H1 of the falling flank of the first quench pulse and the height H2 of the rising flank of the second quench pulse are calculated as weighted sums of the purely bipolar waveform 56 and the purely monopolar waveform 62 with the weight factors 1−p and p.

This method of determining the parameters of the waveform 54 will assure that, for any effective amplitude of the jet pulse 48, the weight p of the bipolar wave function will be as large as possible without leaving the dynamic range of the voltage source.

As mentioned earlier, there are many more reasons to involve the composed quench pulse described above, and there are also many more methods to determine a value for p, indicating the mixture between a pure monopolar waveform (p=0) and a pure bipolar waveform (p=1).

The invention claimed is:

1. A liquid jetting device arranged to eject a droplet of a liquid and comprising a nozzle, a liquid duct connected to the nozzle, an electro-mechanical transducer arranged to create an acoustic pressure wave in the liquid in the duct, and an electronic control system arranged to apply to the transducer a voltage signal having a waveform configured for ejecting a droplet from the nozzle and then quenching a residual acoustic pressure wave in the liquid duct, wherein said waveform comprises a jet pulse, a subsequent first quench pulse having a polarity opposite to that of the jet pulse, and a subsequent second quench pulse having the same polarity as the jet pulse, and wherein the waveform is a blend of a bipolar waveform having only the first quench pulse with a height sufficient to quench the pressure wave with the first quench pulse alone and a monopolar waveform having only the second quench pulse with a height sufficient to quench the pressure wave with the second quench pulse alone, said bipolar and monopolar waveforms being blended with weight factors p and p−1, p being a parameter with a value between 0 and 1.

2. The jetting device according to claim 1, the jetting device being part of an ink jet printer.

3. The jetting device according to claim 1, wherein the jetting device has a plurality of jetting units, each with a respective nozzle, liquid duct and transducer, and the parameter p is individually adjusted for each jetting unit such that a voltage difference between a maximum voltage of the jet pulse and a minimum voltage of the first quench pulse is equal to a voltage range of a voltage source for the respective transducer.

* * * * *